US006887132B2

(12) United States Patent
Kajiwara et al.

(10) Patent No.: US 6,887,132 B2
(45) Date of Patent: May 3, 2005

(54) SLURRY DISTRIBUTOR FOR CHEMICAL MECHANICAL POLISHING APPARATUS AND METHOD OF USING THE SAME

(75) Inventors: Jiro Kajiwara, Saitama-ken (JP); Gerard Moloney, Milpitas, CA (US); Jun Liu, Cupertino, CA (US); Junsheng Yang, Cupertino, CA (US); Ernesto Saldana, San Jose, CA (US); Cormac Walsh, Sunnyvale, CA (US); Alejandro Reyes, San Jose, CA (US)

(73) Assignee: Multi Planar Technologies Incorporated, San Jose, CA (US)

( * ) Notice: Subject to any disclaimer, the term of this patent is extended or adjusted under 35 U.S.C. 154(b) by 0 days.

(21) Appl. No.: 10/234,780

(22) Filed: Sep. 3, 2002

(65) Prior Publication Data

US 2003/0068959 A1 Apr. 10, 2003

Related U.S. Application Data

(60) Provisional application No. 60/323,117, filed on Sep. 10, 2001.

(51) Int. Cl.[7] ..... B24B 1/00

(52) U.S. Cl. ..... 451/41; 451/56; 451/60; 451/287; 451/444

(58) Field of Search ..... 451/41, 56, 60, 451/285–289, 443, 444

(56) References Cited

U.S. PATENT DOCUMENTS 5,645,682 A * 7/1997 Skrovan ..... 438/692
5,709,593 A 1/1998 Guthrie et al.
5,997,392 A 12/1999 Chamberlin et al.
6,051,499 A 4/2000 Tolles et al.
6,280,297 B1 8/2001 Tolles et al.
6,280,299 B1 8/2001 Kennedy et al.
6,283,840 B1 9/2001 Huey
6,284,092 B1 9/2001 Manfredi
6,336,850 B1 1/2002 Wada et al.
6,429,131 B2 8/2002 Lin et al.
6,468,134 B1 10/2002 Gotkis

* cited by examiner

*Primary Examiner*—M. Rachuba
(74) *Attorney, Agent, or Firm*—Dorsey & Whitney LLP

(57) ABSTRACT

A polishing apparatus (100) is provided for polishing a substrate (102) that has slurry distributor (125) which improves planarization uniformity. Generally, the apparatus (100) includes: (i) a platen (106) with a polishing surface (110); (ii) a head (116) adapted to hold the substrate (102) against the polishing surface; (iii) a mechanism to rotate the platen (106) during polishing; (iv) a dispenser (124) having nozzles (126, 128) to dispense slurry on the surface (110); and (v) a distributor (125) between the nozzles (126, 128) and the head (116). In one embodiment, the apparatus (100) further includes a wiper (180) between the head (116) and the distributor (125) to remove used slurry and polishing byproducts from the surface (110), thereby reducing agglomerations or deposits that can damage the substrate (102) and improving yield. Optionally, the apparatus (100) further includes a dispenser (186) for dispensing a cleaning fluid before and/or after the wiper (180) to substantially eliminate buildup of deposits.

44 Claims, 10 Drawing Sheets

SLURRY DISTRIBUTOR FOR CHEMICAL MECHANICAL POLISHING APPARATUS AND METHOD OF USING THE SAME

CROSS REFERENCE TO RELATED APPLICATIONS

The present application claims priority from commonly assigned, co-pending U.S. Provisional Patent Application Ser. No. 60/323,117, filed Sep. 10, 2001, which is incorporated herein by reference.

FIELD OF THE INVENTION

This invention pertains generally to systems, devices, and methods for polishing and planarizing substrates, and more particularly to an apparatus and method for distributing slurry on a polishing surface of a chemical mechanical polishing (CMP) apparatus.

BACKGROUND OF THE INVENTION

As feature size decreases, density increases, and the size of semiconductor wafers or substrates increase, Chemical Mechanical Planarization (CMP) process requirements become more stringent. Substrate to substrate process uniformity as well as intra-substrate planarization uniformity are important issues from the standpoint of producing semiconductor products at a low cost. As the size of dies increases a flaw in one small area increasing results in rejection of a relatively large circuit so that even small flaws have relatively large economic consequences in the semiconductor industry.

Many factors are known in the art to contribute to uniformity problems. These include distribution of a slurry between a surface of the substrate and polishing surface during the polishing operation when there is relative motion between a polishing head on which the substrate is held and the polishing surface during the polishing operation. Slurry is a, usually, chemically active liquid having an abrasive material suspended therein that is used to enhance the rate at which material is removed from the substrate surface.

One problem with slurry distribution in a conventional CMP apparatus a non-uniform distribution of slurry on a polishing surface. FIG. 1 is a top plan view of a platen and a slurry dispenser in a conventional CMP apparatus illustrating a non-uniform distribution of slurry on a polishing surface. Referring to FIG. 1, it is seen that distribution of a slurry 10 across a polishing surface 12 is primarily dependent on the location and orientation of an opening or nozzle 14 of a tube 16 dispensing slurry onto the polishing surface, and on the movement or rotation of a platen (not shown) on which the polishing surface 10 is supported. The speed of movement of the platen is generally determined based on a desired polishing rate, that is a rate at which material is removed from a substrate (not shown) being polished. Thus, traditional approaches to providing an adequate and uniform distribution of slurry between a substrate and a polishing head 18 on which the substrate is held have focused on the location and orientation of the nozzle 14 relative to the polishing head.

As illustrated in FIG. 1, if the nozzle 14 dispenses the slurry too far in radially from an edge 20 of the polishing surface 10 or platen, a portion of the polishing surface beneath the polishing head 18 that is nearest to a center 22 of the polishing surface receives the greatest amount of slurry. As a result, the surface of the substrate near an outer circumferential edge of the polishing head 18 has a higher removal rate than the surface near the center. This pattern is further exacerbated by deformation of the polishing surface 10 by the polishing head 18, which causes the slurry near the edge of the polishing head to be deflected or redirected towards away from the polishing head as shown in FIG. 1.

One prior art approach attempting to provide a more uniform distribution of slurry is described in U.S. Pat. No. 5,709,573, to Guthrie et al. (GUTHRIE). GUTHRIE discloses a radially positioned flexible member in contact with the polishing surface to sweep the slurry across the polishing surface. While an improvement over conventional slurry dispensers, this approach is not wholly satisfactory for a number of reasons.

One problem with the approach taught in GUTHRIE is that the constant contact between the flexible member and the polishing surface during polishing operations causes rapid wear of the flexible member. This in turn leads to the need to frequently replace the flexible member. In addition to the cost of replacement parts, this results in excessive down time or loss of availability or the apparatus for processing due to the time needed to replace the flexible member and the time need to re-characterize the polishing process or apparatus. Moreover, prior to replacement, as the flexible member wears the amount and distribution of slurry across the polishing surface can vary introducing a new source of non-uniformity. This is particularly a problem with polishing surfaces comprising a pattern of features, such as indentations in a porous polishing surface or concentric grooves, for aiding in slurry distribution. These features cause the flexible member to wear unevenly across the surface in contact with the polishing surface, resulting in a nonuniform distribution of slurry across the polishing surface.

Another problem with conventional CMP apparatuses and methods, related to the problem with non-uniform distribution described above, is the inefficient use and wastage of slurry. Because the slurry is dispensed onto the polishing surface ahead of the polishing head, an excess of slurry must typically be dispensed to ensure that when it flows across the polishing surface it will cover the entire area between the substrate and the surface. Because of strict requirements concerning the purity of the slurry and in particular the size of the abrasive particles suspended therein, slurry tends to be expensive. Moreover, because materials used in fabricating semiconductors are often hazardous to people and to the environment, used slurry, which can contain significant amounts of material removed from the substrates, must be disposed of as hazardous waste. Thus, a significant factor in the cost of operating conventional CMP apparatuses is the cost of supplying and disposing of the slurry.

Yet another problem with conventional CMP apparatuses and methods is the buildup of solid polishing byproducts on the polishing surface that can damage or destroy a substrate being polished. These byproducts include material removed from the surface of the substrate and agglomerations of abrasives from old or dried out slurry. This particularly a problem for CMP apparatuses including polishing surfaces with numerous small, shallow grooves for the distribution of slurry, or porous polishing pads or coverings.

Accordingly, there is a need for an apparatus and method that provides a controlled or uniform distribution of slurry across the polishing surface to provide improved planarization uniformity. There is a further need for an apparatus and method capable of restricting slurry dispensed on the polishing surface to the portion of the polishing surface over which the polishing head passes during the polishing operation, thereby reducing waste of slurry. There is a yet further need for an apparatus and method capable of removing used slurry and polishing byproducts from the polishing surface thereby eliminating buildup of solid polishing byproducts that can damage the substrate.

SUMMARY

The present invention relates to an apparatus and method for distributing slurry on a polishing surface of a CMP apparatus that achieves a high-planarization uniformity across a surface of a substrate.

According to one aspect of the present invention, a polishing apparatus is provided for removing material from a surface of a substrate. Generally, the polishing apparatus includes: (i) a platen having a polishing surface thereon; (ii) a polishing head adapted to hold the substrate against the polishing surface during a polishing operation; (iii) a drive mechanism to rotate the platen providing a relative motion between the polishing head and the polishing surface during the polishing operation; (iv) a dispenser having a number of nozzles adapted to dispense chemical on the polishing surface; and (v) a spreader or distributor positioned between the nozzles of the dispenser and the polishing head. The distributor mixes and uniformly distributes chemical between the surface of the substrate and the polishing surface during the polishing operation when there is relative motion between the polishing head and the polishing surface. The chemical can be a slurry having, for example, a solid abrasive material suspended in a fluid, or, where the polishing surface includes a fixed abrasive thereon, the chemical can be water.

In one embodiment, the distributor is made from a rigid, ceramic, glass or polymeric material, such as one or more of the following polymers: polyesters; polyethylene terephthalate; polyimide; polyphenylene sulfide; polyetherketone; polytetrafluoroethylene; and polybenzimidazole, and is adapted to provide a substantially planar lower surface separated from and in a facing relationship with a portion of the polishing surface. The lower surface of the distributor is separated from the polishing surface by a predetermined amount based on a desired removal or polishing rate and in further consideration of the viscosity of the chemical or slurry used. Preferably, the distributor includes a chamfered edge to facilitate movement or flow of the chemical under the lower surface thereof. More preferably, the distributor is oriented to form a predetermined angle relative to a plane of the polishing surface, the predetermined angle selected to further facilitate movement or flow of the chemical under the lower surface thereof. It has been found suitable predetermined angles for most polishing or planarizing operations used in processing semiconductor substrates are from about 10 to about 80 degrees. More preferably, the predetermined angles are from about 20 to about 40 degrees, and most preferably about 30 degrees.

In another embodiment, the distributor further includes one or more guide or spacers on the lower surface thereof, the spacers adapted to contact the polishing surface during a polishing operation and to guide or position the distributor relative to the polishing surface. Preferably, the spacers include an adjustment mechanism to adjust a gap between the lower surface of the distributor and the polishing surface, thereby enabling a rate of removal of material from the substrate to be varied.

Optionally, polishing apparatus further includes an actuator for positioning the distributor against or adjacent to the polishing surface. Generally, the actuator can include spring actuators, gravity actuators, hydraulic actuators, pneumatic actuators, or electromagnetic actuators, such as solenoids.

The nozzles can be located distal from or proximal to the distributor. In one embodiment, the nozzles are abutting or affixed to a support supporting the distributor in position over the polishing surface. Optionally, one or more of the nozzles are adapted to dispense the chemical at a different rate than the remainder of the nozzles. For example, nozzles near either an inner or outer end of the dispenser can dispense chemical at a lower rate than those more centrally located to more tightly focus or constrain the chemical on that portion of the polishing surface over which the polishing head will pass. Alternatively, the nozzle near the inner end of the dispenser can dispense chemical at a higher rate than the other nozzles to compensate for a lower speed of the portion of the polishing surface near a center of the rotating platen, thereby providing a more uniform removal rate throughout the rotation of the substrate on the polishing head. Typically, each of the nozzles is adapted to dispense from about 20 milliliters (ml) to about 200 ml of chemical per second.

Alternatively, the distributor is oriented to form a predetermined angle relative to a radius of the polishing surface. The predetermined angle can be adjusted or selected to direct more or less of the chemical to an inner or outer portion of the polishing surface, thereby altering the removal rate over a portion of the polishing surface or more tightly focusing on the polishing head. Preferably, the predetermined angle selected to uniformly distribute the chemical in the path of the polishing head. It has been found suitable predetermined angles for most polishing or planarizing operations used in processing semiconductor substrates are from about 1 to about 30 degrees. More preferably, the predetermined angles are from about 2 to about 20 degrees, and most preferably less than about 10 degrees.

In yet another aspect, the invention is directed to a polishing apparatus including, in addition to a distributor adapted to mix and uniformly distribute a chemical or slurry on a polishing surface, a wiper adapted to remove used chemical and polishing byproducts from the polishing surface after the surface has passed under a polishing head. Generally, the wiper is positioned between the polishing head and the distributor, and is oriented to form an angle relative to a radius of the polishing surface, to direct the used chemical and polishing byproducts off an outer edge of the polishing surface or platen. Preferably, the wiper forms an angle of from about 5 to about 30 degrees relative to a radius of the polishing surface.

In one embodiment, the wiper further includes a vacuum port to vacuum used chemical and polishing byproducts from the polishing surface. This is particularly advantageous for use with a polishing surface having features such as grooves or a porous polymer polishing pad.

In another embodiment, the polishing apparatus can further include a cleaning fluid dispenser for dispensing a cleaning fluid, such as water, onto the polishing before and/or after the wiper to clean the polishing surface during a cleaning operation. In one version of this embodiment, the cleaning fluid dispenser is adapted to dispense cleaning fluid on the polishing surface ahead or upstream of the wiper during the polishing operation to reduce or substantially eliminate buildup of solid polishing byproducts that can damage the substrate.

In yet another aspect, the invention is directed to a method of polishing a substrate having a surface using a polishing apparatus having a polishing surface and a polishing head adapted to hold the substrate during a polishing operation. Generally, the method involves: (i) positioning the substrate on the polishing head; (ii) holding the polishing head so as to press the surface of the substrate against the polishing surface; (iii) dispensing a chemical onto the polishing surface using a dispenser having a number of nozzles through which the chemical is dispensed; and (iv) mixing and uniformly distributing the chemical on the polishing surface using a distributor positioned between the nozzles and the polishing head.

Optionally, the method can further include the step of removing used chemical and polishing byproducts from the polishing surface after the chemical has passed under the polishing head using a wiper positioned between the polishing head and the distributor. Preferably, the wiper has a lower surface with a linear edge in contact with a portion of the polishing surface substantially entirely along the length of the linear edge. More preferably, the wiper or the linear edge thereof forms a predetermined angle relative to a radius of the polishing surface, the predetermined angle selected to direct the used chemical and polishing byproducts off an outer edge of the polishing surface or platen.

Advantages of the apparatus and method of the present invention include any or all of the following:

(i) improved planarization uniformity due to uniform distribution of slurry across the polishing surface;

(ii) improved planarization uniformity of substrates initially having non-planar layers deposited thereon, due to tailored or focused distribution of slurry across the polishing surface;

(iii) reduced wasting of slurry, due to tailored or focused distribution of slurry across the polishing surface; and (iv) improved yields due to reduction or eliminating of buildup or deposits of solid polishing byproducts that can damage the substrate.

BRIEF DESCRIPTION OF THE DRAWINGS

These and various other features and advantages of the present invention will be apparent upon reading of the following detailed description in conjunction with the accompanying drawings, where.

DETAILED DESCRIPTION

The inventive structure and method are now described in the context of specific exemplary embodiments illustrated in the figures. Those skilled in the art will appreciate that various changes and modifications can be made while remaining within the scope of the claimed invention. For example, for purposes of clarity the invention is described in context of a Chemical Mechanical Polishing (CMP) system having a single polishing head. However, those skilled in the art will appreciate that the apparatus and method of the invention can also be utilized with CMP systems having multiple polishing heads.

Figure 1:
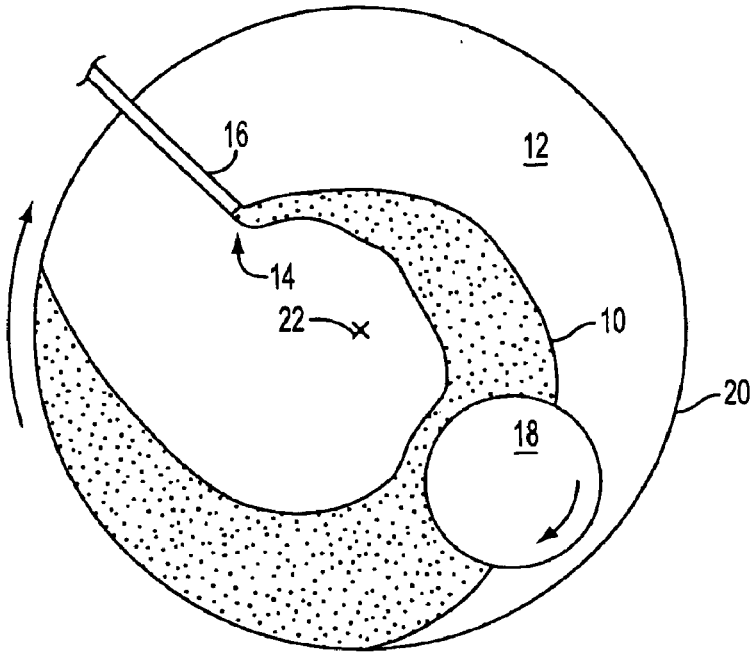
FIG. 1 (PRIOR ART)
FIG. 1 (prior art) is a top plan view of a platen and a slurry dispenser in a conventional CMP apparatus illustrating a non-uniform distribution of slurry on a polishing surface.
Figure 2:
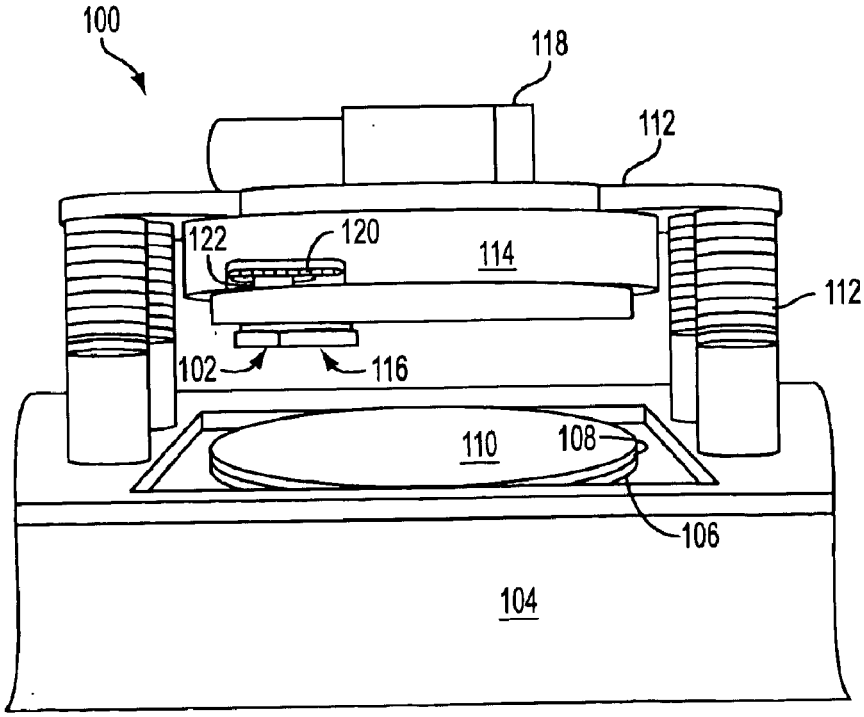
FIG. 2 (PRIOR ART)
FIG. 2 (prior art) is a diagrammatic illustration showing an exemplary CMP apparatus for which a slurry delivery system and method according to the present invention are particularly useful.

Referring to FIG. 1, there is shown an embodiment of a chemical mechanical polishing or planarization (CMP) apparatus 100 for polishing substrates 102. As used here the term "polishing" means either polishing or planarization of substrates 102, including substrates used in flat panel displays, solar cells and, in particular, semiconductor substrates or wafers onto which electronic circuit elements have been deposited. Semiconductor wafers are typically thin and fragile disks having diameters nominally between 100 mm and 300 mm. Currently 100 mm, 200 mm, and 300 semiconductor wafers are widely used in the industry. The inventive method and apparatus 100 are applicable to semiconductor wafers and other substrates 102 at least up to 300 mm diameter as well as to larger diameter substrates.

For purposes of clarity, many of the details of the CMP apparatus 100 that are widely known and are not relevant to the present invention have been omitted. CMP apparatuses 100 are described in more detail in, for example, in commonly assigned, co-pending U.S. patent applications Ser. No. 09/570,370, filed 12 May 2000 and entitled System and Method for Pneumatic Diaphragm CMP Head Having Separate Retaining Ring and Multi-Region Wafer Pressure Control; Ser. No. 09/570,369, filed 12 May 2000 and entitled System and Method for CMP Having Multi-Pressure Zone Loading For Improved Edge and Annular Zone Material Removal Control; and Ser. No. 09/854,189, filed 11 May 2001 and entitled System and Method for CMP Having Multi-Pressure Annular Zone Subcarrier Material Removal Control, each of which is incorporated herein by reference in its entirety.

The CMP apparatus 100 includes a base 104 rotatably supporting a large rotatable platen 106 with a polishing pad 108 mounted thereto, the polishing pad having a polishing surface 110 on which the substrate 102 is polished. The polishing pad 108 is typically a polyeurethane material, such as that available from RODEL of Newark Del. Additionally, a number of recesses (not shown in FIG. 1), such as grooves or cavities, may be provided in the polishing surface 110 to distribute a chemical or slurry (not shown in FIG. 1) between the polishing surface and a surface of a substrate 102 placed thereon. By slurry it is meant a chemically active liquid having an abrasive material suspended therein that is used to enhance the rate at which material is removed from the substrate surface. Typically, the slurry is chemically active with at least one material on the substrate 102 and has a pH of approximately 4 to 11. For example, one suitable slurry consists of approximately 12% abrasive and 1% oxidizer in a water base, and includes a colloidal silica or alumina having a particle size of approximately 100 nm. Optionally, as an alternative or in addition to the slurry, the polishing surface 110 of the polishing pad 108 can have a fixed abrasive material embedded therein, such as available from Minnesota Mining and Manufacturing Company. In embodiments of CMP apparatuses 100 having a polishing surface 110 with a fixed abrasive, the chemical dispensed onto the polishing surface during polishing operations can be water. The base 104 also supports a bridge 112 that in turn supports a carousel 114 having one or more polishing heads 116 (only one of which is shown) on which substrates 102 are held during a polishing operation. The bridge 112 is designed to permit raising and lowering of the carousel 114 to bring surfaces of substrates 102 held on the polishing heads 116 into contact with the polishing surface 110 during the polishing operation. In this particular CMP design, the polishing head 116 is driven by a motor 118 that drives a chain 120, which in turn drives the polishing head via a chain and sprocket mechanism 122. In addition to the rotation of the polishing pad 108 and the polishing head 116, the carousel 114 can be moved to orbit about a fixed central axis of the polishing platen 106 to provide an orbital motion to the polishing head. Furthermore, the inventive distributor and wiper (not shown in this figure) may be utilized in all manner of CMP apparatuses 100 including machines utilizing a linear or reciprocating motion as are well known in the art.

In accordance with the present invention, the CMP apparatus further includes a chemical or slurry dispenser 124 and a distributor 125 which will now be described with reference to FIGS. 3 to 14.

Figure 3:
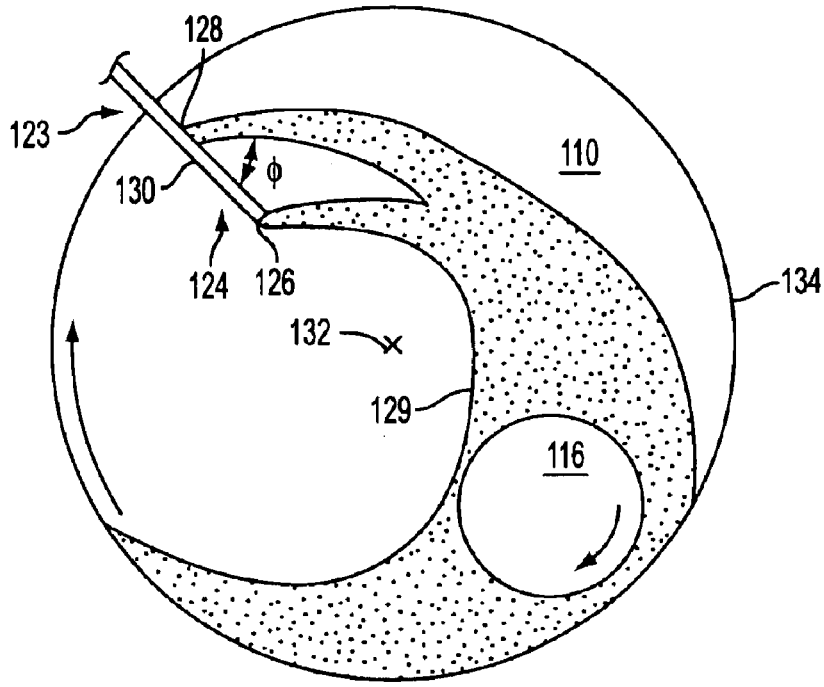
FIG. 3 is a top plan view of a platen and a slurry dispenser having multiple nozzles adapted to uniformly distribute slurry on a polishing surface according to an embodiment of the present invention.

FIG. 3 is a top plan view of a polishing surface 110 and slurry delivery apparatus 123 having a slurry dispenser 124 with multiple nozzles 126, 128, adapted to uniformly distribute a chemical or slurry 129 on the polishing surface 110 according to an embodiment of the present invention. Referring to FIG. 3, a first nozzle 126 at a distal end of a delivery tube 130 located near a center 132 of the polishing surface 110 to dispense a stream or flow of slurry 129 onto a portion of the polishing surface that will pass under the polishing head 116 near to the center 132 of the polishing surface 110. A second nozzle 128 generally located on the delivery tube 130 nearer to an outer circumferential edge 134 of the polishing surface 110 dispenses a stream or flow of slurry 129 onto a portion of the polishing surface 110 that will pass under the polishing head 116 near to the edge 134 of the polishing surface. It will be appreciated that the angle and a rate at which the slurry 129 is dispensed from each nozzle 126, 128, can be altered or varied to achieve a more tailored distribution of slurry. For example, in the embodiment shown in FIG. 3, the rate at which slurry 129 is dispensed from the second nozzle 128 can be reduced, or an angle $\Phi$ at which it is dispensed relative to the delivery tube 130 can be reduced to more tightly focus the slurry on the polishing head 116, thereby reducing waste of the slurry or chemical.

Alternatively, the nozzles 126, 128, of the slurry dispenser 124 shown in FIG. 3 can be sized, located and oriented to provide a heterogeneous distribution of slurry 129 across the polishing surface 110 to achieve a desired polishing profile. For example, copper layers, which have become increasingly common in high-speed integrated circuits, tend to form a convex layer thicker at the center of the substrate 102 than at the edge. Thus, to provide a higher removal rate near the center of the substrate 102 than at the edge it may be desirable to direct the stream of slurry from both nozzles towards the center of the substrate 102 held on the polishing head.

Figure 4:
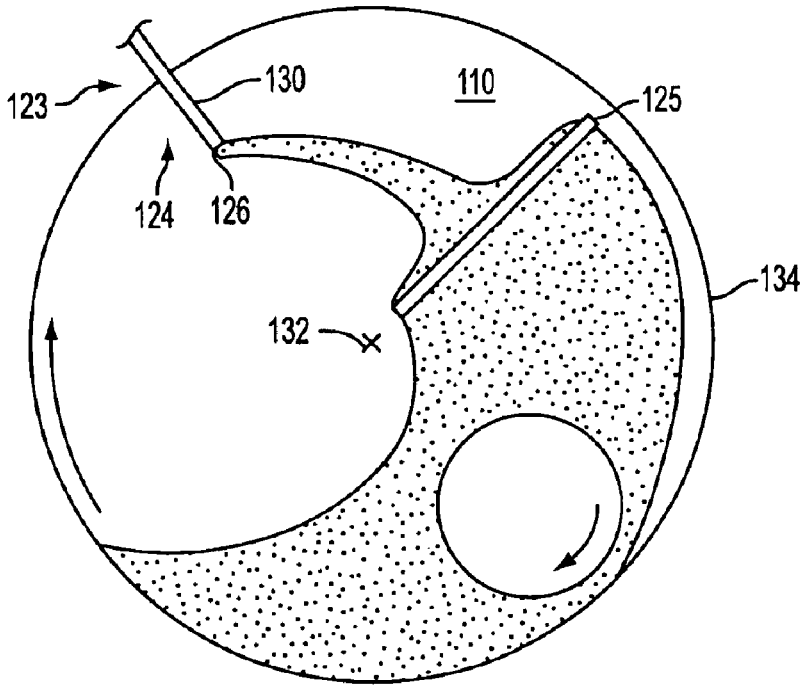
FIG. 4 is a top plan view of a slurry dispenser and a distributor to mix and uniformly distribute slurry on a polishing surface according to an embodiment of the present invention.

An embodiment of the distributor 125 according to the present invention will now be described with reference to FIG. 4. FIG. 4 is a top plan view of a slurry delivery apparatus 123 having slurry dispenser 124 and a distributor 125 to mix and uniformly distribute slurry on the polishing surface 110 according to an embodiment of the present invention. Referring to FIG. 4, the distributor is positioned between the delivery tube 130 and the polishing head 116 to mix and spread or distribute chemical or slurry 129 between the surface of the substrate 102 and the polishing surface 110 during the polishing operation. In the embodiment shown, the distributor 125 is a rigid bar or member having a linear shape that extends across at least a portion of the polishing surface 110. In this embodiment, the linear distributor 125 has a length that is greater than or substantially equal to the diameter of the polishing head 116 to provide a sufficient amount of slurry 129 between the substrate 102 and the polishing surface.

Alternatively, the distributor 125 can include an arc or a curved member, or two or more members intersecting at angles to direct the slurry to provide a desired non-uniform distribution of slurry 129 across the polishing surface 110. For example, for planarizing copper layers as noted above.

Generally, the distributor 125 is adapted to provide a shape having a substantially planar lower surface (not shown in this figure) separated from and in a facing relationship with a portion of the polishing surface 110. Preferably, to reduce or eliminate potential contamination of the substrate 102 during the polishing operation, the distributor 125 is made from a glass, ceramic, or rigid high purity polymer material. More preferably, the distributor 125 is made from a material commonly used in retaining rings (not shown) disposed about the substrate 102 held on the polishing head 116 in a conventional CMP apparatus. Most preferably, the distributor is made from a polymer thick film (PTF) including one or more of the following polymers: polyesters; polyethylene terephthalate; polyimide; polyphenylene sulfide; polyetherketone; polytetrafluoroethylene; and polybenzimidazole.

The lower surface of the distributor 125 is separated from the polishing surface 110 by a predetermined amount or gap based on a thickness of a layer or film of slurry required to provide a desired removal or polishing rate. In addition to the desired polishing rate, the predetermined gap by which the distributor 125 is separated from the polishing surface 110 further depends on a viscosity of the chemical or slurry 129 used.

Figure 5:
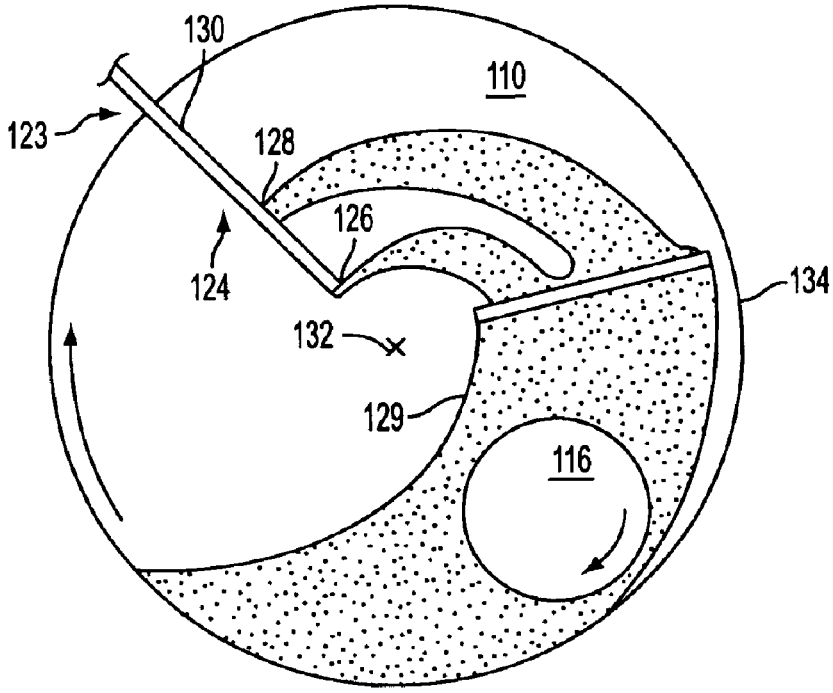
FIG. 5 is a top plan view of a slurry dispenser having multiple non-uniformly sized nozzles and a distributor to mix and uniformly distribute slurry on a polishing surface according to an embodiment of the present invention.

Another embodiment of the slurry delivery apparatus 123 will now be described with reference to FIG. 5. FIG. 5 is a top plan view of a slurry delivery apparatus 123 having a distributor 125 and a slurry dispenser 124 with multiple nonuniformly sized nozzles 126, 128. Referring to FIG. 5, positioning a smaller first nozzle 126 having a lower slurry dispensing rate at the distal end of the delivery tube 130 reduces the excess of slurry flowing past the edge of the polishing head 116 near the center 132 of the polishing surface 110, thereby reducing waste of slurry. It will be appreciated that the slurry dispenser 124 can include any number of nozzles that can be sized, located and oriented to achieve any desired distribution of slurry.

Figure 6:
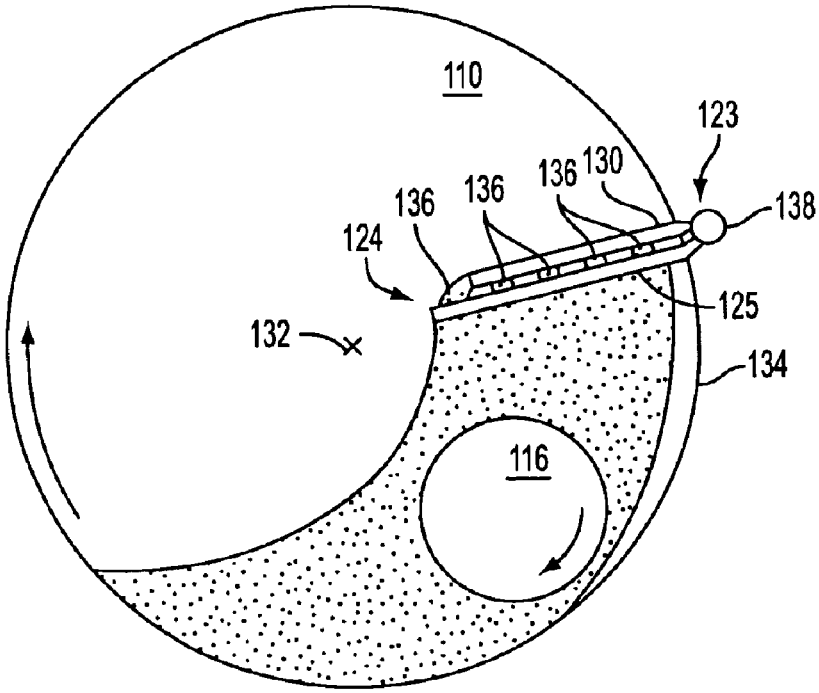
FIG. 6 is a top plan view of a slurry dispenser having multiple nozzles located proximal to a distributor adapted to mix and uniformly distribute slurry on a polishing surface according to an embodiment of the present invention.

FIG. 6 is a top plan view of another embodiment of a slurry delivery apparatus 123 having a distributor 125 integrated or combined with the slurry dispenser 124. Referring to FIG. 6, the slurry dispenser 124 includes a delivery tube 130 having multiple nozzles 136 located near or proximal to the upstream side of the distributor 125 to mix and uniformly distribute slurry 129 on the polishing surface 110. The delivery tube 130 and the distributor 125 are supported in position over the polishing surface by a support 138. Optionally, the delivery tube 130 and the distributor 125 can be attached to pivot or rotate about the support 138 to provide unobstructed access to the polishing surface 110 and/or platen 106. Slurry 129 or chemical can be coupled to the delivery tube 130 through a rotatable fluid union (not shown) or through flexible tubing (not shown).

Figure 7:
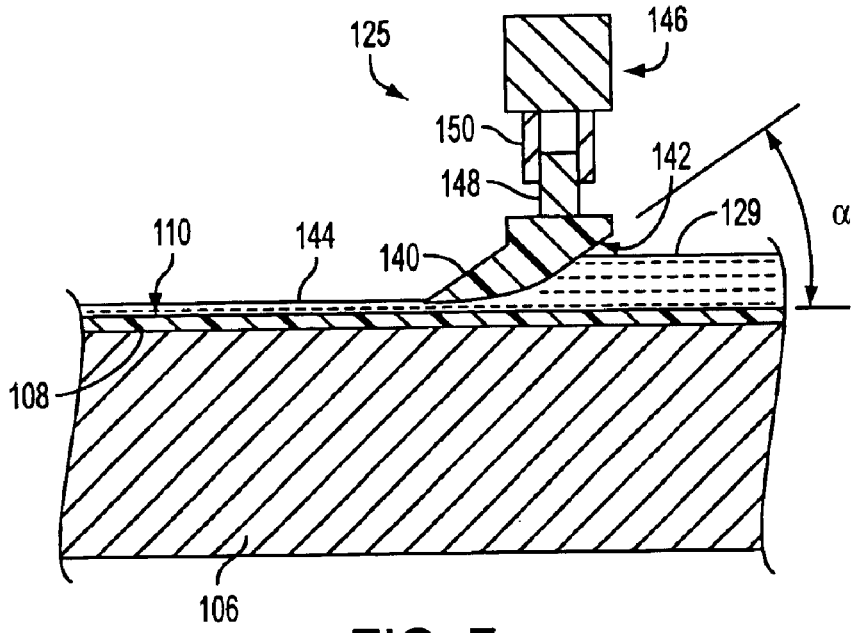
FIG. 7 is a partial cross-sectional side view of a distributor and a platen showing a chamfered edge of a lower surface of the distributor, and an actuator for positioning the distributor relative to the polishing surface according to an embodiment of the present invention.

FIG. 7 is a partial cross-sectional side view of an embodiment of the distributors 125 illustrated in FIGS. 3 to 6, showing the platen 106, a polymer polishing pad 108 with a polishing surface 110 thereon, and a distributor having a chamfered edge 140 on a lower surface 142 thereof. Referring to FIG. 7, the chamfered edge 140 forms an angle, $\propto$, relative to the polishing surface 110 adapted to facilitate flow of the slurry 129 under the distributor 125, thereby improving the uniformity of distribution across the polishing surface. If the angle is too small, the resultant film or layer 144 of slurry 129 is either too thick or, if the quantity of the slurry is too little, no distribution is achieved. It has also been found that if the angle is too great, the slurry 129 will accumulate behind the distributor 125, eventually flowing radially inward and outward along ends thereof, again resulting in a non-uniform distribution or layer 144 of undesired thickness. Suitable predetermined angles for most polishing or planarizing operations used in processing semiconductor substrates are from about 10 to about 80 degrees. More preferably, the predetermined angles are from about 20 to about 40 degrees, and most preferably about 30 degrees.

FIG. 7 also illustrates an embodiment of the distributor 125 further including an actuator 146 for positioning the distributor above or against the polishing surface 110. In accordance with the present invention, the actuator 146 can apply a force urging or pushing the chamfered edge 140 of the distributor 125 towards the polishing surface 110 and rely on the hydraulic force or pressure of the slurry 129 or chemical on the moving polishing surface to lift the chamfered edge so that it glides or flies over the polishing surface. Alternatively, the actuator 146 can be adapted to move the chamfered edge 140 of the distributor 125 by a predetermined limited distance to provide the desired predetermined gap by which it is separated from the polishing surface 110. In one version of this embodiment, movement of the chamfered edge 140 by the actuator 146 is limited by a stop (not shown), which can be adjusted to provide layers 144 having different thicknesses for different polishing recipes.

Generally, the actuator 146 is selected from a group consisting of: gravity actuators; hydraulic actuators; pneumatic actuators; and electromagnetic actuators or solenoids. In the embodiment shown the actuator 146 includes a piston 148 slidably fitted into a chamber 150 into which a hydraulic or pnematic fluid is introduced, or from which it is withdrawn, to re-position the chamfered edge 140 of the distributor 125. It should be noted that the piston 148 and the chamber 150 can include one or more cylindrical pistons and chambers spaced apart along the length of the distributor 125, or a rectangular piston and chamber that extend substantially the entire length of the distributor. In a preferred embodiment, the actuator 146 includes a single hydraulic or pneumatic piston and cylinder, or a single solenoid joining or coupling the distributor 125 to the support 138 (not shown in this figure).

Figure 8:
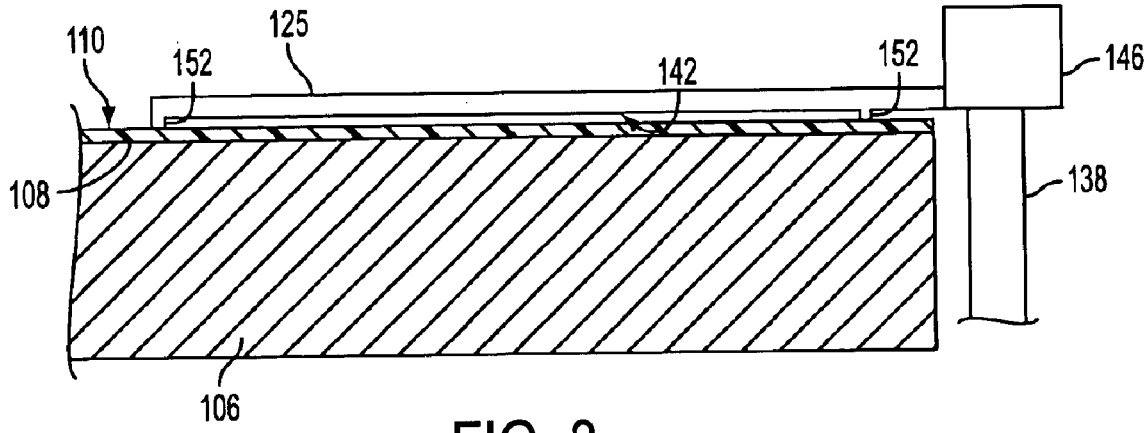
FIG. 8 is a partial cross-sectional view of a platen and a side view of a distributor having spacers adapted to position the distributor relative to a polishing surface according to an embodiment of the present invention.

In another embodiment, the distributor 125 further includes one or more guides or spacers 152 on the lower surface 142 thereof, the spacers adapted to contact the polishing surface 110 during a polishing operation and to guide or position the distributor relative to the polishing surface. FIG. 8 is a partial cross-sectional side view of the platen 106, a polymer polishing pad 108 having a polishing surface 110 thereon, and a distributor 125 having spacers 152 adapted to position the distributor relative to the polishing surface. Referring to FIG. 8, in one embodiment the distributor 125 is adapted to be lowered by the actuator 146 joining it to the support 138 until the spacers 152 contact the polishing surface. The spacers 152 can be integrally formed with the rest of the distributor 125 or can be separate components attached to the lower surface 142 thereof. Because the spacers 152 can be formed separately from the rest of the distributor 125, they need not be made of the same material. Thus, the spacers 152 can be made from a material selected to provide properties including enhanced wear resistance. Moreover, because the spacers 152 can be located to contact the polishing surface 110 only in an area outside of the portion of the polishing surface in contact with the polishing head 116, the possibility of contamination of the substrate 102 by material from the spacers is reduced, thereby further eliminating constraints on choice of material for the spacers. In one preferred embodiment, the height of the spacer 152 can be adjusted or varied by an adjustment mechanism (not shown), such as a threaded rod or screw, or shims, thereby enabling the height of the distributor 125 over the polishing surface 110 to be adjusted for different polishing recipes or to compensate for wear of the spacers or other CMP apparatus 100 components.

Figure 9:
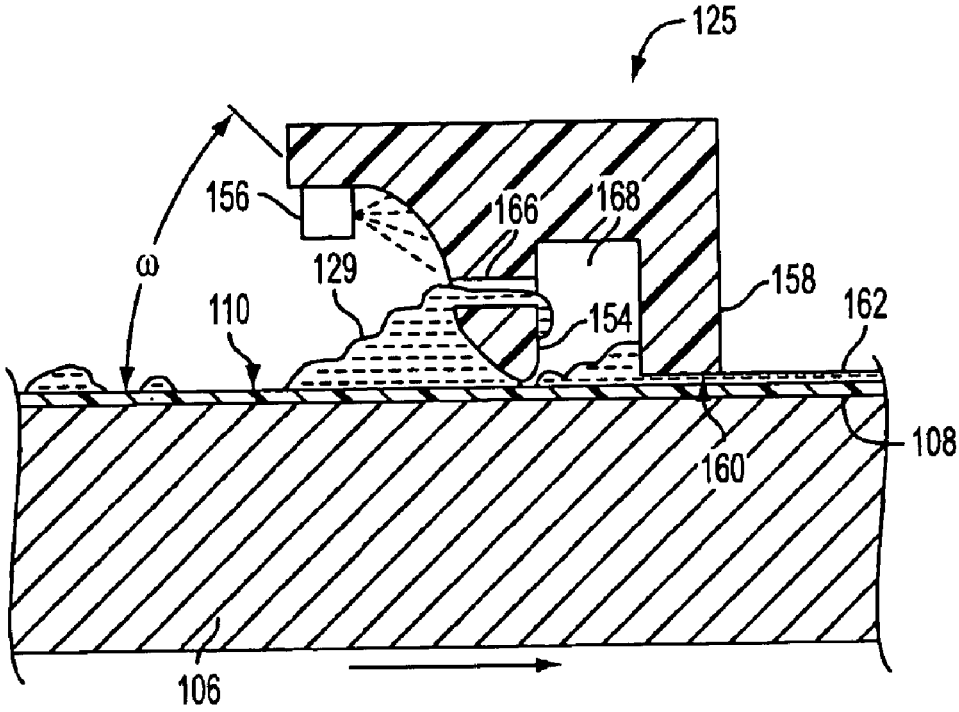
FIG. 9 is a partial cross-sectional side view of a distributor and a platen showing a chamfered leading edge, an integral dispenser and a trailing edge with a lower surface adapted to provide a micro-layer or metered amount of slurry on a polishing surface according to an embodiment of the present invention.

A preferred embodiment of a distributor according to the present invention will now be described with reference to FIGS. 9 to 12. FIG. 9 shows a distributor 125 having a chamfered leading edge 154, an integral dispenser 156 and a trailing edge 158 with a lower surface 160 adapted to provide a micro-layer 162 or metered amount of slurry on a polishing surface 110. Referring to FIG. 9, a chemical or slurry 129 sprayed or dispensed from integral dispenser 156 causes slurry to accumulate behind the leading, angled surface of chamfered leading edge 154. The slurry 129 accumulating behind the chamfered leading edge 154 is forced against the polishing surface 110 by the chamfered leading edge substantially entirely fills numerous concentric grooves 164 in the polishing pad 108 (shown in FIG. 10). After the slurry 129 accumulating behind the chamfered leading edge 154 grows or builds-up to a sufficient level, it passes through one or more ports 166 extending through the chamfered leading edge into metering chamber 168. Slurry 129 or chemical in the metering chamber 168 in combination with the trailing edge 158 forms micro-layer 162 on the polishing surface 110 as the polishing surface continues to move under the distributor 125.

Optionally, where the used slurry 129 is not removed from the polishing surface 110 after it has passed under the polishing head 116, the chamfered leading edge 154 further serves to recover this used slurry.

Figure 10:
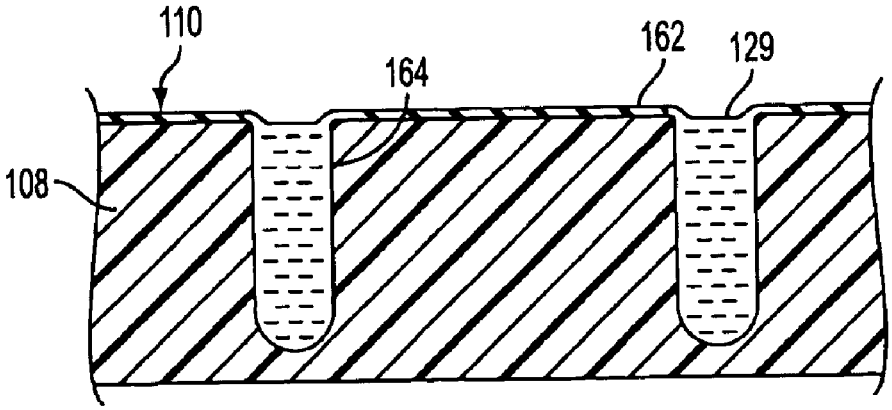
FIG. 10 is a partial cross-sectional side view of a polishing surface having grooves therein showing the filled with slurry by the distributor of FIG. 9.

The ability of the distributor 125 of FIG. 9 to substantially completely fill the grooves 164 in the polishing surface 110 and to provide a uniform micro-layer 162 thereon is illustrated in FIG. 10. The substantially completely filled grooves 164 provide a source of slurry 129 the polishing surface 110 under a central portion of the polishing head 116, thereby providing unparalleled polishing uniformity.

Figure 11:
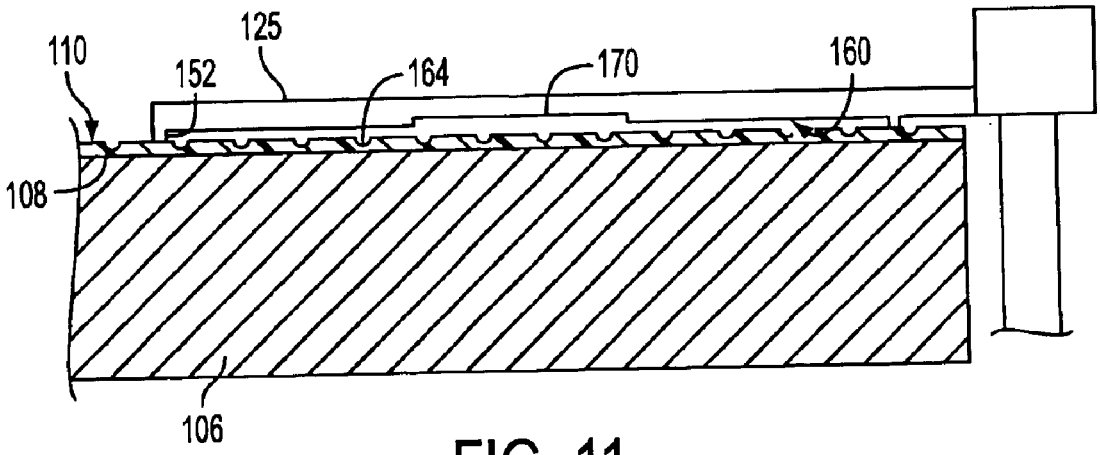
FIG. 11 is a front view of the distributor of FIG. 9 showing a trailing edge having a lower surface with a raised center according to an embodiment of the present invention.

FIG. 11 is a front view of the distributor of FIG. 9 showing an alternative embodiment in which the lower surface 160 of the trailing edge 158 has a raised center portion 170 to provide a region of the polishing surface 110 having thicker layer of slurry 129 thereon. As noted above, for certain substrates 102 or processes, for example, planarizing copper layers, it is desirable to provide a higher removal rate near the center of the substrate 102 than at the edge. Optionally, the lower surface 160 of the trailing edge 158 can further include spacers 152 to position or assist in positioning the distributor 125 relative to the polishing surface during a polishing operation.

Figure 12:
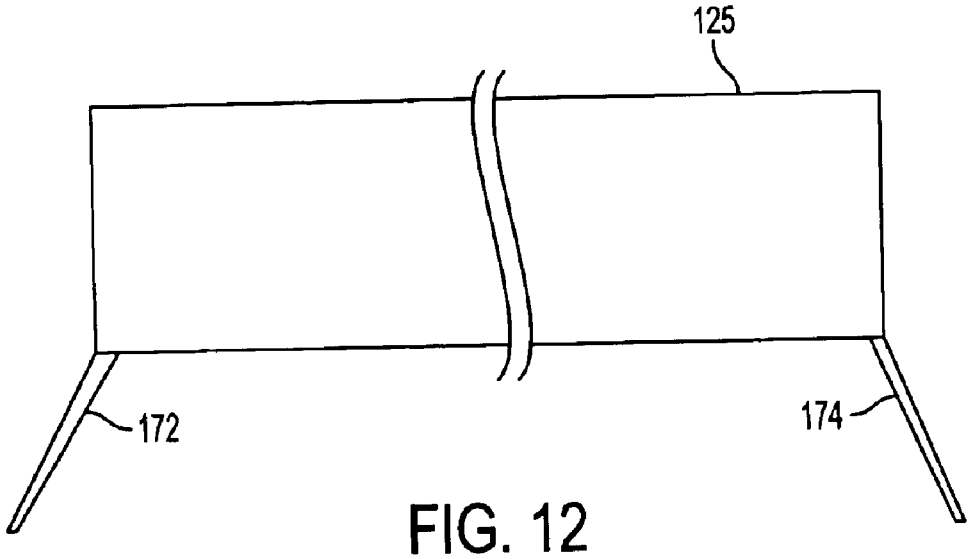
FIG. 12 is a partial top plan view of a distributor and a platen showing the distributor of FIG. 9 further including wings to direct recovered slurry back the distributor according to an embodiment of the present invention.

In yet another embodiment shown in FIG. 12, the distributor further includes wings 172, 174, to direct residual slurry remaining on the polishing surface back to the distributor. FIG. 12 is a partial top plan view of the distributor of FIG. 9 showing a distributor 125 further including wings. Referring to FIG. 12, the wings 172, 174, can be separate independently fabricated elements or components which are attached to the distributor 125, or can be integrally form one or more components of the distributor including the chamfered leading edge 154 and the trailing edge 158. The wings 172, 174, can be attached to sides 176, 178, of the distributor 125 or to the chamfered leading edge 154. Generally, the wings 172, 174, which with the chamfered leading edge 154 contact the polishing surface 110 are made from the same material as the chamfered leading edge.

Figure 13:
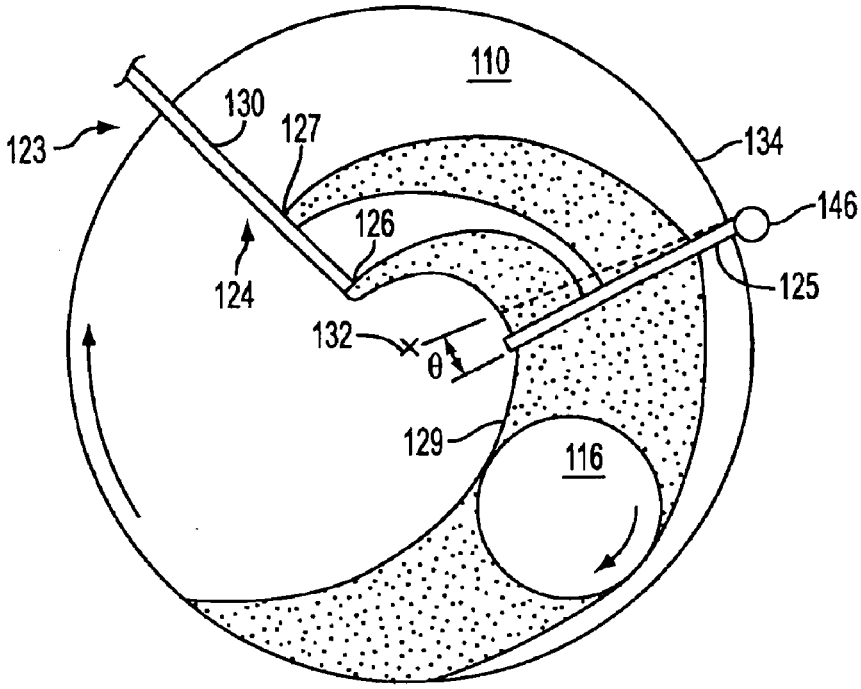
FIG. 13 is a partial top plan view of a distributor and a platen showing an angle of the distributor relative to a radius of the platen according to an embodiment of the present invention.

FIG. 13 is a partial top plan view of the distributor 125 showing an angle of the distributor relative to a radius of the platen 106 according to an embodiment of the present invention. Referring to FIG. 13, it has been found that angling the distributor relative to a radius of the platen 106 or polishing surface 110 can redirect slurry 129 on the polishing surface tailoring polishing rates, and focus or limit the stream or flow of slurry 129 onto only the portion of the polishing surface 110 that will pass under the polishing head 116, thereby reducing waste of slurry. In the embodiment, shown the angling of the distributor 125 relative to a radius of the polishing surface 110 is used in combination with a slurry dispenser 124 have multiple differently sized nozzles to substantially focus or limit the slurry to the portion of the polishing surface 110 that will pass under the polishing head 116. It will be appreciated that angling the distributor 125 so that the inside end precedes the outer end will result in the slurry being re-directed toward the edge 134 of the polishing surface 110. Angling the distributor 125 so that the outer end precedes the inside end will result in the slurry being re-directed toward the center 132 of the polishing surface 110. Increasing or larger angles, $\mu$, increase the degree or amount by which the slurry is re-directed.

Figure 14:
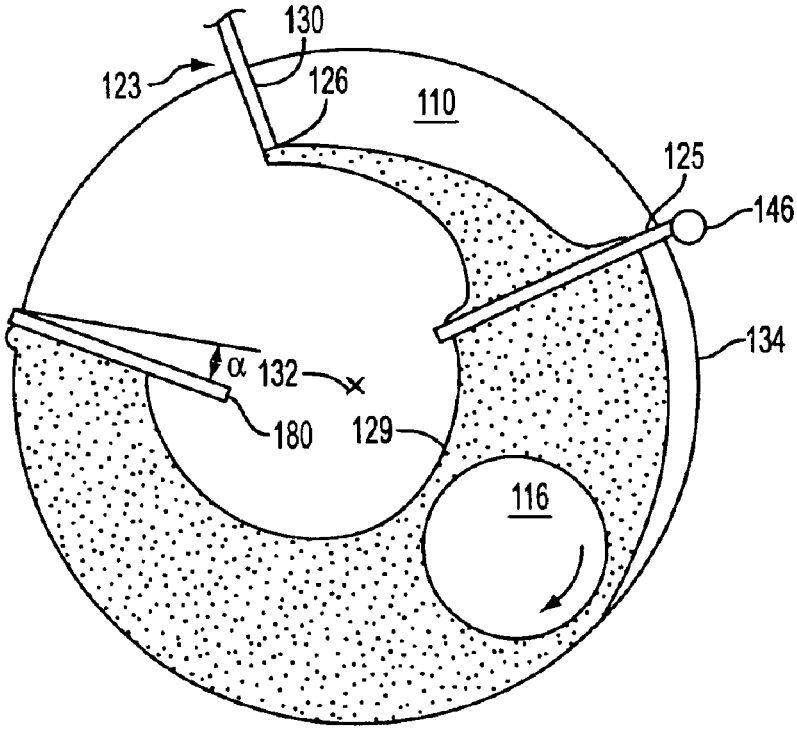
FIG. 14 is a top plan view of a slurry dispenser positioned between to a distributor and a wiper on a polishing surface, the wiper adapted to remove used slurry and polishing byproducts from the polishing surface according to an embodiment of the present invention.

In another aspect, the invention is directed to a CMP apparatus 100 including, in addition to the distributor 125, a wiper 180 adapted to remove used chemical or slurry 129 and polishing byproducts from the polishing surface 110 after it has passed under a polishing head 116. FIG. 14 is a top plan view of a wiper 180 on the polishing surface 110. Referring to FIG. 14, the wiper 180 is positioned between the polishing head 116 and the distributor 125, and is oriented to form an angle, $\gamma$, relative to a radius of the polishing surface 110, to direct the used slurry 129 and polishing byproducts off the edge 134 of the polishing surface or platen 106. The wiper 180 is angled so that the inside end precedes the outer end to re-direct the slurry toward the edge 134 of the polishing surface 110. Preferably, the wiper forms an angle of from about 5 to about 30 degrees relative to a radius of the polishing surface. Generally, the wiper 180, which is in contact with the polishing surface 110 is made from the same or similar material as that of the distributor 125.

Figure 15:
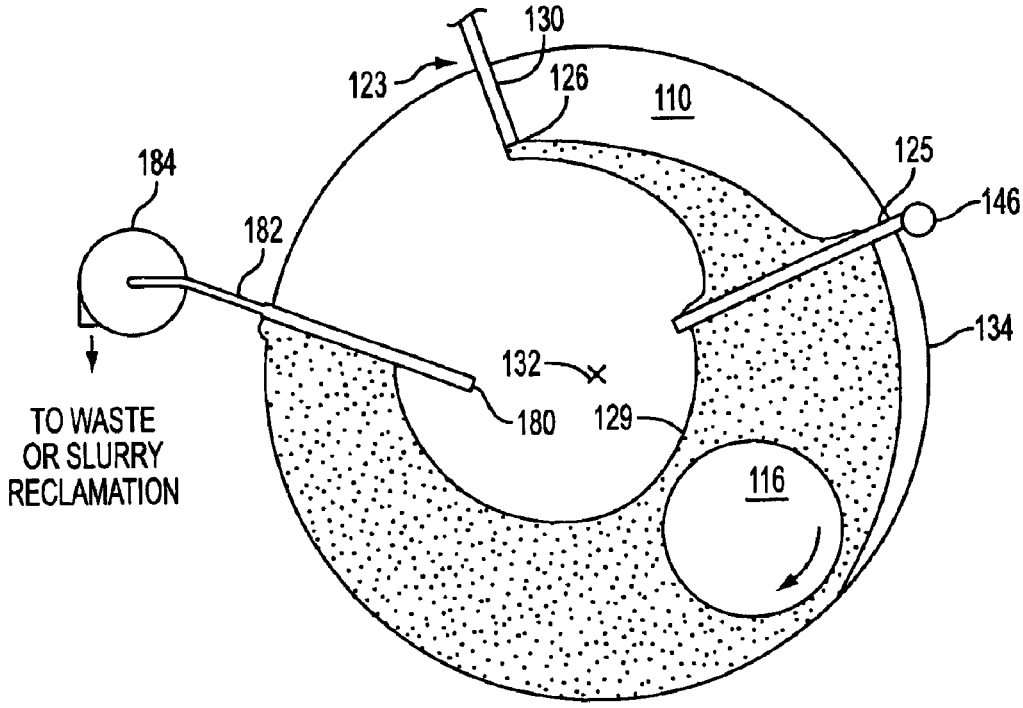
FIG. 15 is a top plan view of an embodiment of the wiper of FIG. 14 further including a vacuum to remove used slurry and polishing byproducts from the polishing surface according to an embodiment of the present invention.

In one embodiment, shown in FIG. 15, the wiper 180 further includes a vacuum port (not shown) coupled via a vacuum line 182 to a vacuum pump 184 to vacuum used chemical and polishing byproducts from the polishing surface. This embodiment is particularly advantageous for use with a polishing surface 110 having features such as grooves 164 or a porous polymer polishing pad 108.

Figure 16:
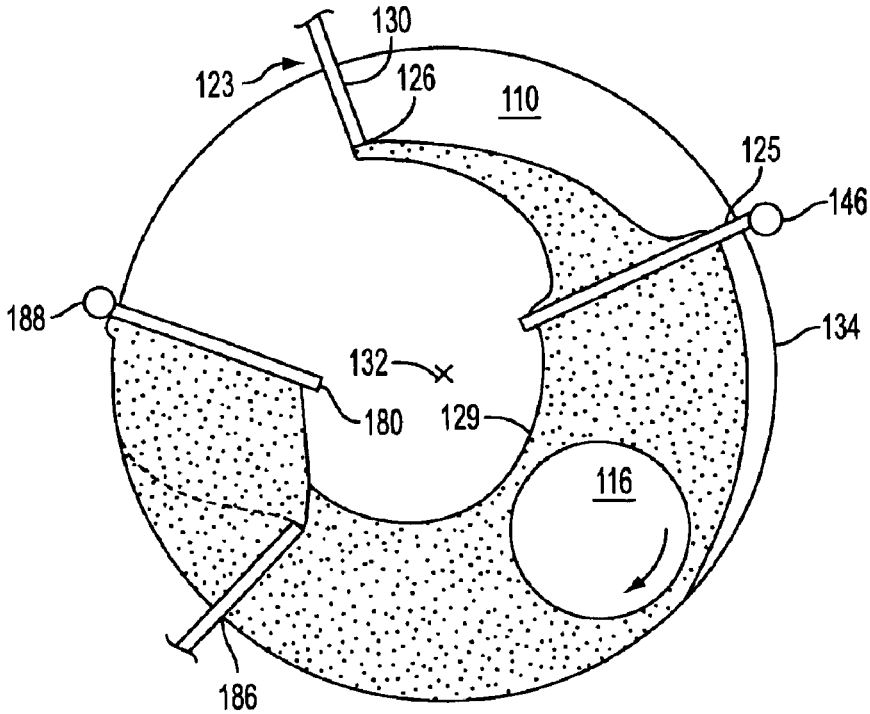
FIG. 16 is a top plan view of a polishing surface of an apparatus having a wiper and a cleaning fluid dispenser(s) adapted to remove used slurry and polishing byproducts from the polishing surface according to an embodiment of the present invention.

In another embodiment, shown in FIG. 16, the CMP apparatus 100 can further include a cleaning fluid dispenser 186 for dispensing a cleaning fluid, such as water, onto the polishing surface 110 before and/or after the wiper 180 to clean the polishing surface during a cleaning operation. In one version of this embodiment, the cleaning fluid dispenser 186 is adapted to dispense cleaning fluid onto the polishing surface 110 ahead or upstream of the wiper 180 during the polishing operation to reduce or substantially eliminate buildup of solid polishing byproducts that can damage the substrate 102.

As with the distributor 125, the wiper 180 can be joined to a support (not shown) via an actuator 188 that is capable of raising and lowering the wiper into position in contact with the polishing surface 110. The actuator 188 can include a spring actuators, gravity actuators, hydraulic actuators, pneumatic actuators, or electromagnetic actuators, such as solenoids.

Figure 17:
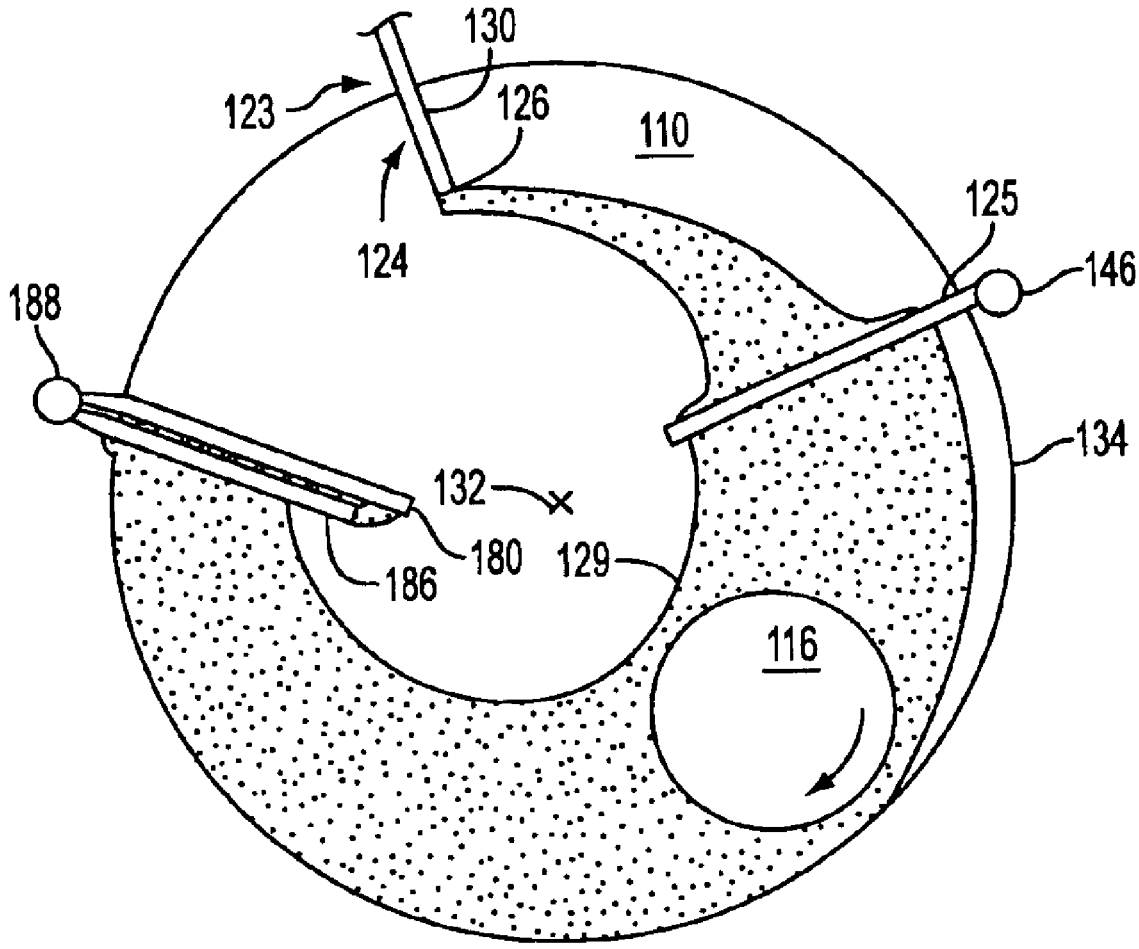
FIG. 17 is a top plan view of a polishing surface of an apparatus having a wiper and a cleaning fluid dispenser abutting the wiper according to an embodiment of the present invention.

FIG. 17 is yet another embodiment of the CMP apparatus 100 according to present invention having a cleaning fluid dispenser 186 integrally formed with or abutting the wiper 180.

Figure 18:
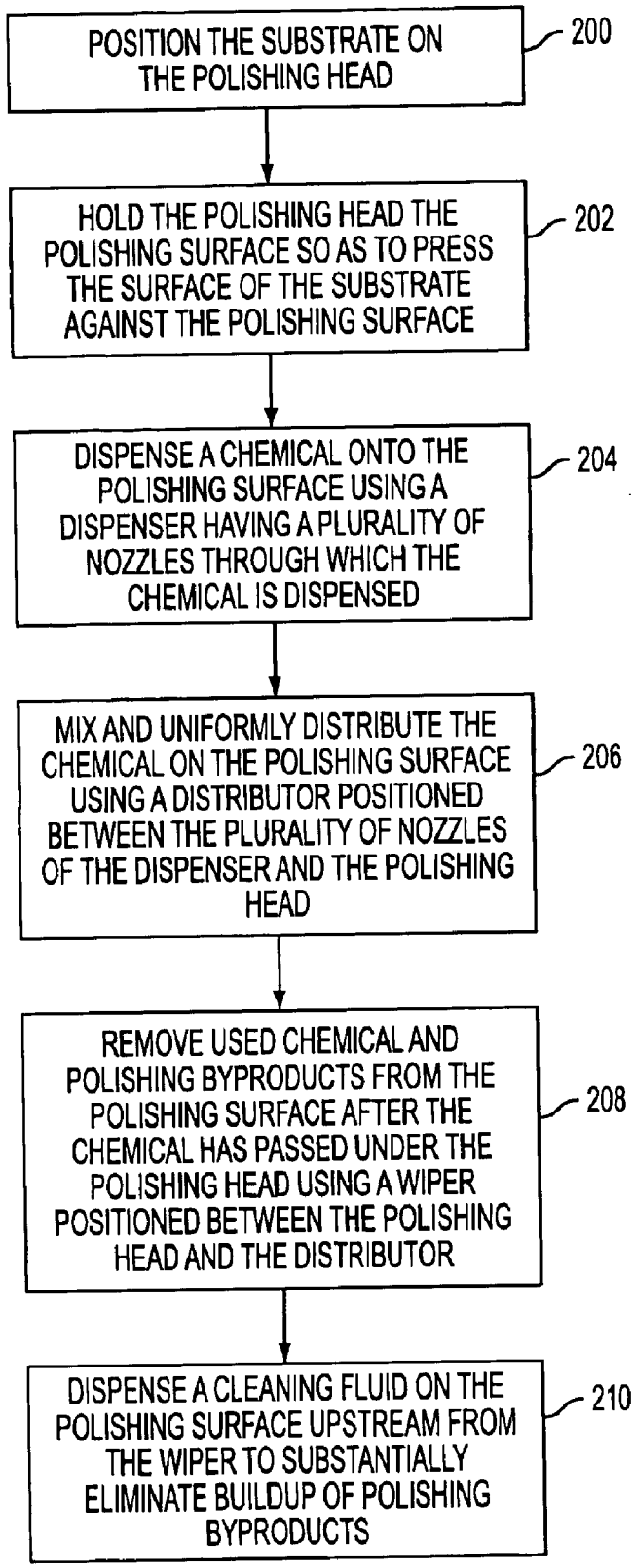
FIG. 18 is a flowchart showing an embodiment of a process for polishing or planarizing a substrate according to an embodiment of the present invention.

A method of operating a CMP apparatus 100 according to the present invention will now be described with reference to FIG. 18. FIG. 18 is a flowchart showing an embodiment of a process for polishing or planarizing a substrate 102 according to an embodiment of the present invention. Generally, the method involves: (i) positioning the substrate 102 on the polishing head 116 (step 200); (ii) holding the polishing head 116 so as to press the surface of the substrate 102 against the polishing surface 110 (step 202); (iii) dispensing a chemical or slurry 129 onto the polishing surface 110 using a dispenser 124 having a number of nozzles 126, 128, through which the chemical is dispensed (step 204); and (iv) mixing and uniformly distributing the chemical on the polishing surface 110 using a distributor 125 positioned between the nozzles 126, 128, and the polishing head 116 (step 206).

Optionally, the method can further include the step of removing used chemical or slurry and polishing byproducts from the polishing surface 110 after the chemical has passed under the polishing head 116 using a wiper 180 positioned between the polishing head 116 and the distributor 125 (step 208). Preferably, the method further includes the step of dispensing a cleaning fluid on the polishing surface 110 upstream from the wiper 180 to substantially eliminate buildup of polishing byproducts (step 210).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

We claim:

1. A polishing apparatus for removing material from a surface of a substrate, the polishing apparatus comprising:

a platen having a polishing surface thereon;

a polishing head adapted to hold the substrate against the polishing surface during a polishing operation;

a drive mechanism to rotate the platen providing a relative motion between the polishing head and the polishing surface during the polishing operation;

a dispenser having a plurality of nozzles adapted to dispense chemical on the polishing surface; and a distributor positioned between the plurality of nozzles of the dispenser and the polishing head, whereby the distributor mixes and uniformly distributes chemical between the surface of the substrate and the polishing surface during the polishing operation when there is relative motion between the polishing head and the polishing surface during the polishing operation.

2. A polishing apparatus according to claim 1, wherein the distributor comprises a rigid material, and is adapted to provide a substantially planar lower surface separated from and in a facing relationship with a portion of the polishing surface.

3. A polishing apparatus according to claim 1, wherein the polishing surface comprises a plurality of concentric grooves therein, and wherein the distributor comprises:

a chamfered leading edge adapted to substantially fill the plurality of concentric grooves;

an integral dispenser; and a trailing edge with a lower surface adapted to provide a micro-layer on the polishing surface.

4. A polishing apparatus according to claim 1, wherein the chemical comprises a slurry.

5. A polishing apparatus according to claim 1, wherein the polishing surface comprises a polishing surface having a fixed abrasive thereon and wherein the chemical comprises water.

6. A polishing apparatus according to claim 1, wherein at least one of the plurality of nozzles is adapted to dispense an amount of chemical different than the remainder of the plurality of nozzles.

7. A polishing apparatus according to claim 6, wherein each of the plurality of nozzles is adapted to dispense from about 20 milliliters (ml) to about 200 ml of chemical.

8. A polishing apparatus according to claim 1, wherein the plurality of nozzles are located abutting the distributor.

9. A polishing apparatus according to claim 1, wherein the plurality of nozzles are affixed to a support supporting the distributor in position over the polishing surface.

10. A polishing apparatus according to claim 1, wherein the distributor comprises a chamfered leading edge.

11. A polishing apparatus according to claim 1, wherein the distributor is oriented to form a predetermined angle relative to a plane of the polishing surface, the predetermined angle selected to re-direct the chemical on the polishing surface.

12. A polishing apparatus according to claim 11, wherein the distributor forms an angle of from about 20 to about 40 degrees relative to a plane of the polishing surface.

13. A polishing apparatus according to claim 1, further comprising an actuator for positioning the distributor above the polishing surface.

14. A polishing apparatus according to claim 13, wherein the actuator comprises an actuator selected from a group consisting of:

gravity actuators;

hydraulic actuators;

pneumatic actuators; and electro-magnetic actuators.

15. A polishing apparatus according to claim 1, wherein the distributor is oriented to form a predetermined angle relative to a radius of the polishing surface, the predetermined angle selected to uniformly distribute the chemical in the path of the polishing head.

16. A polishing apparatus according to claim 15, wherein the distributor forms an angle of from about 2 to about 20 degrees relative to a radius of the polishing surface.

17. A polishing apparatus according to claim 1, wherein distributor further comprises at least one spacer on a lower surface thereof, the at least one spacer positioned between the distributor and the polishing surface adapted to contact the polishing surface during a polishing operation and to position the distributor relative to the polishing surface.

18. A polishing apparatus according to claim 17, wherein the at least one spacer comprises an adjustment mechanism to adjust the gap between the lower surface of the distributor and the polishing surface, whereby a rate of removal of material from the substrate can be varied.

19. A polishing apparatus according to claim 1, wherein the at least one spacer comprises a material in contact with the polishing surface during the polishing operation selected from a group consisting of:

a polymeric material;

a ceramic material; and a glass material.

20. A polishing apparatus for removing material from a surface of a substrate, the polishing apparatus comprising:

a platen having a polishing surface thereon;

a polishing head adapted to hold the substrate against the polishing surface during a polishing operation;

a drive mechanism to rotate the platen providing a relative motion between the polishing head and the polishing surface during the polishing operation;

a dispenser having a plurality of nozzles adapted to dispense chemical on the polishing surface;

a distributor positioned between the plurality of nozzles of the dispenser and the polishing head to mix and uniformly distribute chemical on the polishing surface during the polishing operation; and a wiper positioned between the polishing head and the distributor to remove used chemical and polishing byproducts from the polishing surface after the chemical has passed under the polishing head.

21. A polishing apparatus according to claim 20, wherein the wiper is oriented to form a predetermined angle relative to a radius of the polishing surface, the predetermined angle selected to direct the used chemical and polishing byproducts off an outer edge of the platen, whereby the used chemical and polishing byproducts are removed from the polishing surface.

22. A polishing apparatus according to claim 21, wherein the wiper forms an angle of from about 5 to about 30 degrees relative to a radius of the polishing surface.

23. A polishing apparatus according to claim 20, wherein the wiper further includes a vacuum port to remove used chemical and polishing byproducts from the polishing surface.

24. A polishing apparatus according to claim 20, further including a cleaning fluid dispenser position before or after the wiper to dispense a cleaning fluid onto the polishing surface, whereby buildup of polishing byproducts is substantially eliminated.

25. A polishing apparatus according to claim 24, wherein the cleaning fluid dispenser is affixed to a support supporting the wiper on the polishing surface.

26. A method of polishing a substrate having a surface using a polishing apparatus having a polishing surface and a polishing head adapted to hold the substrate during a polishing operation, the method comprising steps of:

positioning the substrate on the polishing head;

holding the polishing head on the polishing surface so as to press the surface of the substrate against the polishing surface;

dispensing a chemical onto the polishing surface using a dispenser having a plurality of nozzles through which the chemical is dispensed; and mixing and uniformly distributing the chemical on the polishing surface using a distributor positioned between the plurality of nozzles of the dispenser and the polishing head.

27. A method according to claim 26, wherein the polishing surface comprises a plurality of concentric grooves therein, and the distributor comprises a chamfered leading edge, an integral dispenser, and a trailing edge with a lower surface, and wherein the step of mixing and uniformly distributing the chemical on the polishing surface using the distributor comprises the steps of:

substantially filling the plurality of concentric grooves using the chamfered leading edge; and providing a micro-layer on the polishing surface using the lower surface of the trailing edge.

28. A method according to claim 26, further comprising the step of removing used chemical and polishing byproducts from the polishing surface after the chemical has passed under the polishing head using a wiper positioned between the polishing head and the distributor.

29. A method according to claim 28, further comprising the step of dispensing a cleaning fluid on the polishing surface upstream from the wiper to substantially eliminate buildup of polishing byproducts.

30. A polishing apparatus according to claim 2, wherein a gap between the lower surface of the distributor and the polishing surface is based on a thickness of a layer of chemical required to provide a desired polishing rate.

31. A polishing apparatus according to claim 2, wherein a gap between the lower surface of the distributor and the polishing surface is dependent on a viscosity of a dispensed chemical.

32. A polishing apparatus according to claim 20, wherein a gap between a lower surface of the distributor and the polishing surface is based on a thickness of a layer of chemical required to provide a desired polishing rate.

33. A polishing apparatus according to claim 20, wherein a gap between a lower surface of the distributor and the polishing surface is dependent on a viscosity of a dispensed chemical.

34. A method of polishing a substrate according to claim 26, wherein a gap between the lower surface of the distributor and the polishing surface is based on a thickness of a layer of chemical required to provide a desired polishing rate.

35. A method of polishing a substrate according to claim 26, wherein a gap between a lower surface of the distributor and the polishing surface is dependent on a viscosity of a dispensed chemical.

36. A polishing apparatus according to claim 1, wherein a lower surface of the distributor being separated from and in a facing relationship with the polishing surface.

37. A polishing apparatus according to claim 20, wherein a lower surface of the distributor being separated from and in a facing relationship with the polishing surface.

38. A polishing method according to claim 26, wherein a lower surface of the distributor being separated from and in a facing relationship with the polishing surface.

39. A polishing apparatus according to claim 1, wherein the distributor further comprises at least one spacer on a lower surface thereof positioned between the distributor and the polishing surface and adapted to contact the polishing surface during a polishing operation and to position the distributor relative to the polishing surface.

40. A polishing apparatus according to claim 39, wherein the at least one spacer including an adjustment mechanism to adjust the gap between the lower surface of the distributor and the polishing surface so that a rate of removal of material from the substrate can be varied.

41. A polishing apparatus according to claim 39, wherein the at least one spacer comprises a material in contact with the polishing surface during the polishing operation selected from a group consisting of: a polymeric material, a ceramic material, and a glass material.

42. A polishing apparatus according to claim 1, wherein the distributor comprises a rigid material, and is adapted to provide a substantially planar lower surface.

43. A polishing apparatus according to claim 41, wherein a gap between the lower surface of the distributor and the polishing surface is based on a thickness of a layer of chemical required to provide a desired polishing rate.

44. A polishing apparatus according to claim 42, wherein a gap between the lower surface of the distributor and the polishing surface is dependent on a viscosity of a dispensed chemical.

* * * * *